US006042067A

United States Patent [19]

Mendelsohn et al.

[11] Patent Number: 6,042,067

[45] Date of Patent: Mar. 28, 2000

[54] CLAMPING HOLDER FOR A LAMP FOR A FLOWERPOT

[76] Inventors: Fred M. Mendelsohn, 1214 W. Cass St., Tampa, Fla. 33606; Simon A.H. Lee, 316 Chungli City, Taoyuan Hsien, Taiwan

[21] Appl. No.: 09/236,544

[22] Filed: Jan. 25, 1999

[51] Int. Cl.[7] ..... A47B 96/06

[52] U.S. Cl. ..... 248/213.2; 248/313

[58] Field of Search ..... 248/213.2, 312, 248/312.1, 313, 229.15, 229.25

[56] References Cited

U.S. PATENT DOCUMENTS 4,327,887 5/1982 Kumakura ..... 248/229.15 X 5,873,555 2/1999 Crace ..... 248/312.1

*Primary Examiner*—Ramon O. Ramirez

*Attorney, Agent, or Firm*—A. W. Fisher, III

[57] ABSTRACT

A clamping holder for a lamp used for a flowerpot comprising an inverse "U" shaped main body having a lock seat and a clamping bolt, the main body is formed on the two ends thereof respectively a shovel shaped insertion arm and a plain clamping arm. The insertion arm is for inserting into the soil for positioning the clamping holder. The plain clamping arm is provided with a threaded hole for screwing therein the clamping bolt. Thereby the clamping holder is firmly mounted on the flowerpot or the flower nursery platform, while a lock seat provided thereon is used to mount the lamp. Convenience of use and firmness of fixing of the flowerpot lamp can thus be achieved.

2 Claims, 5 Drawing Sheets

CLAMPING HOLDER FOR A LAMP FOR A FLOWERPOT

BACKGROUND OF THE INVENTION

1. Field of the Invention

The present invention is related to a clamping holder for a lamp used for a flowerpot. The clamping holder is designed for the environment of flower nursery platforms or flowerpots. The clamping holder is used to mount a lamp firmly above a flower nursery platform or a flowerpot. The angular position of the lamp bar connected with the clamping holder can be adjusted; thereby the best distance and angle of illumination and the position of the lamp mounted can be controlled. This is good for use by an expert cultivating flowers or fruits or vegetables to increase firmness of a lamp mounted for cultivating.

2. Description of the Prior Art

Flowers, fruits and vegetables are all plant, they can only grow under photosynthesis, especially those precious flowers under professional cultivation need plenty of sunshine and water supplied carefully by and cultivator in a greenhouse in order to adjust the directions of growing of the leaves or blossoms in photosynthesis. In the professional cultivation by an expert, flowers or fruits or vegetables need suitable amount of water; this is quite easy for man work cultivation. However, it is hard to control illumination of sunshine, and thereby light supplied by lamps is used instead to cultivate flowerpots. Nowadays, it is extremely popular to use light of lamps to cultivate the plants planted in flowerpots and flower or vegetable nursery platforms to compensate insufficiency of sunshine.

It is known that, there is no special lamp for mounting or clamping in position in the environment of plant cultivation. The lamp mounting technique used presently on flower or vegetable nurseries in greenhouses only uses table lamps on stands or with clamping claws to place or clamp the lamps on platforms for plant cultivation. However, normally the nearest one to the environment of plant cultivation is soil or a flowerpot having soil. Conventional lamps clamped or placed on tables are not suitable to be located above the soil or a flowerpot having soil. It is often that a lamp used for cultivating plants is not firmly clamped or placed, thereby it is subjected to a trouble of tilting or falling down. Under the condition of unstable clamping or placing, the cultivator is hard to operate to adjust the light of the lamp to control the angle and distance of illumination and the position of the lamp mounted. This is exactly the problem to be solved.

SUMMARY OF THE INVENTION

A design for a specific lamp for plants must take into consideration the applicability of mounting the lamp on a flowerpot obtained from markets and having soil. Thereby, the lamp must be mounted with a clamping device (or clamping holder) for fixing; this will be better than the way to place the lamp on a platform. Moreover, there are various designs in the markets for adjustable lamp bars and lampshades, and these are not inclusive in the present invention. The present invention is related to using a clamping holder to lock a lamp bar adjustable for its height and orientation. The clamping holder thereby can firmly mount the lamp together with the lamp bar, the lampshade and the lamp tube or lamp bulb thereof on a flowerpot having soil therein or clamp them on a flower nursery platform. The clamping holder further provides function of pivotal connection and clamping locking for the lamp bar. That is, the lamp will be adjustable in orientation and suitably held for convenient use by a cultivator in cultivating flowers or fruits or vegetables, so as to increase firmness as well as convenience in mounting and adjusting a professional flowerpot lamp or plant lamp.

To achieve the above stated object, the clamping holder of the present invention must be designed in favor of insertion thereof into soil and clamping on the wall of a flowerpot.

The present invention will be apparent after reading the detailed description of the preferred embodiment thereof in reference to the accompanying drawings.

DETAILED DESCRIPTION OF THE PREFERRED EMBODIMENT

Figure 1:
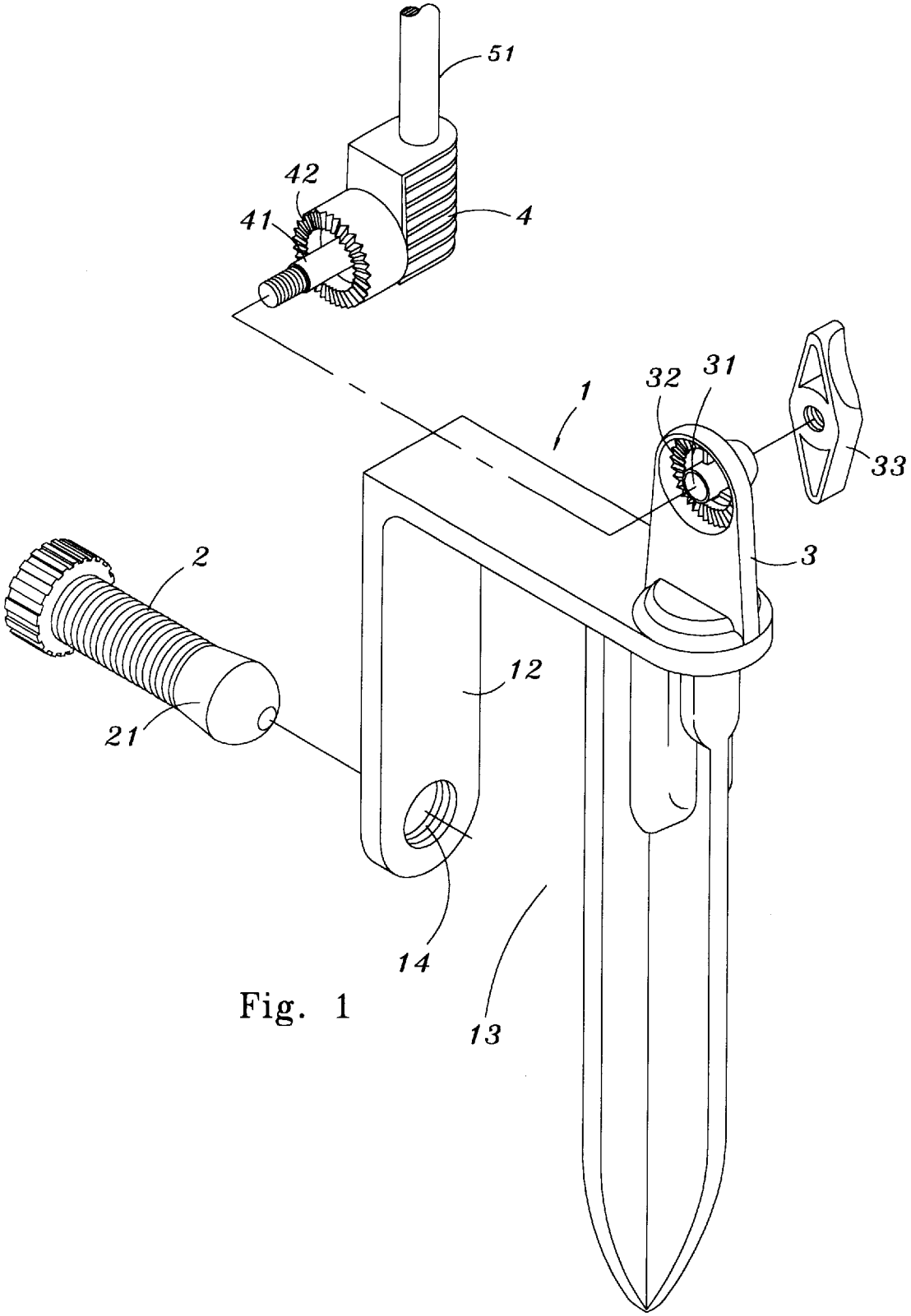
FIG. 1 is a perspective view of the clamping holder of the present invention with a connector for the lamp bar.

Referring to FIG. 1, the clamping holder for a flowerpot lamp provided in the present invention is comprised of an inverse "U" shaped main body 1 which is formed on the two ends thereof respectively a shovel shaped insertion arm 11 and a plain clamping arm 12, wherein:

The opposite sides facing to each other of the shovel shaped insertion arm 11 and the plain clamping arm 12 can both be made plane, a clamping space is formed therebetween (as shown in FIG. 1).

Figure 4:
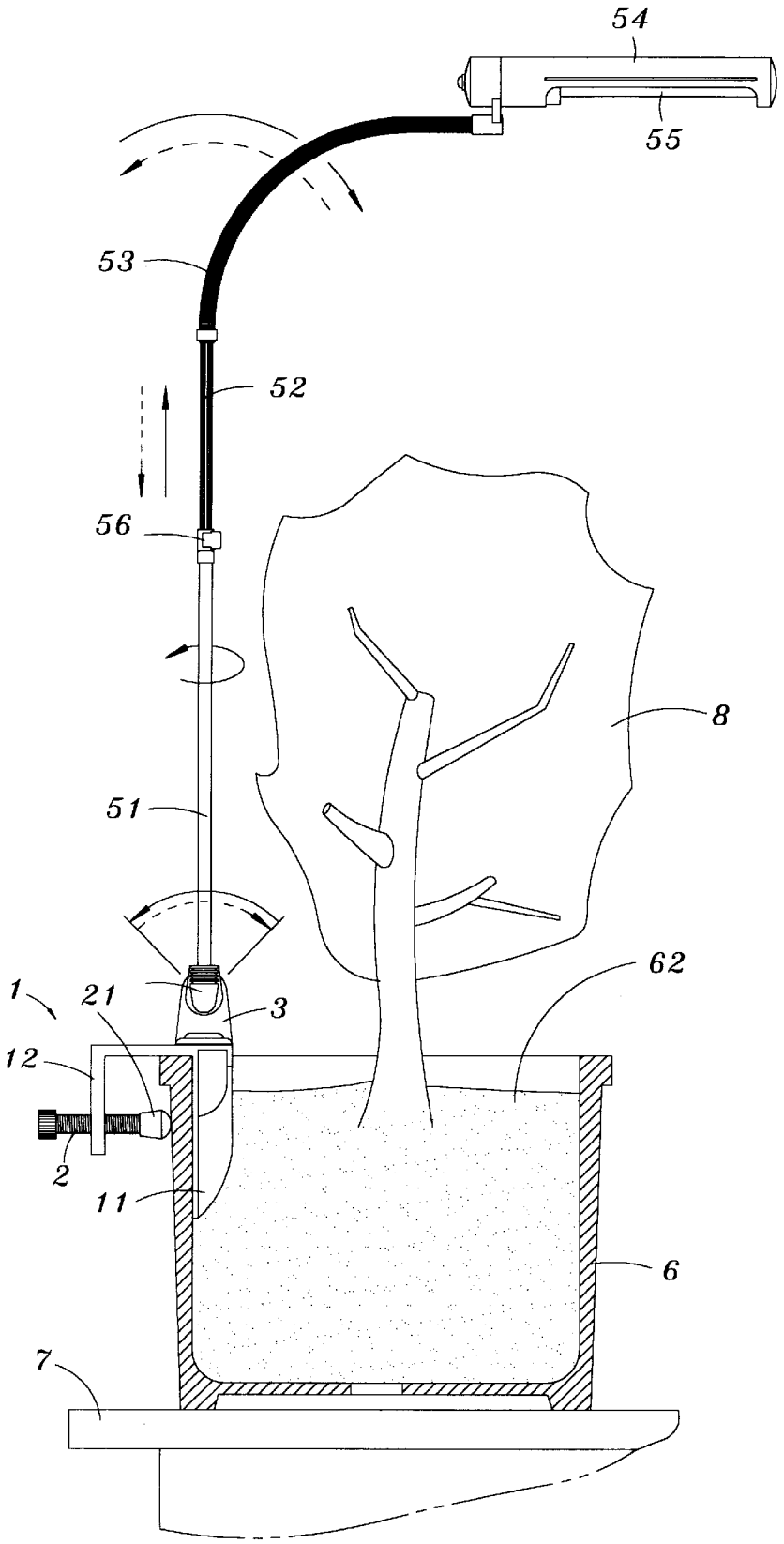
FIG. 4 is a schematic view showing clamping of the clamping holder of the present invention on a flowerpot above soil.
Figure 5:
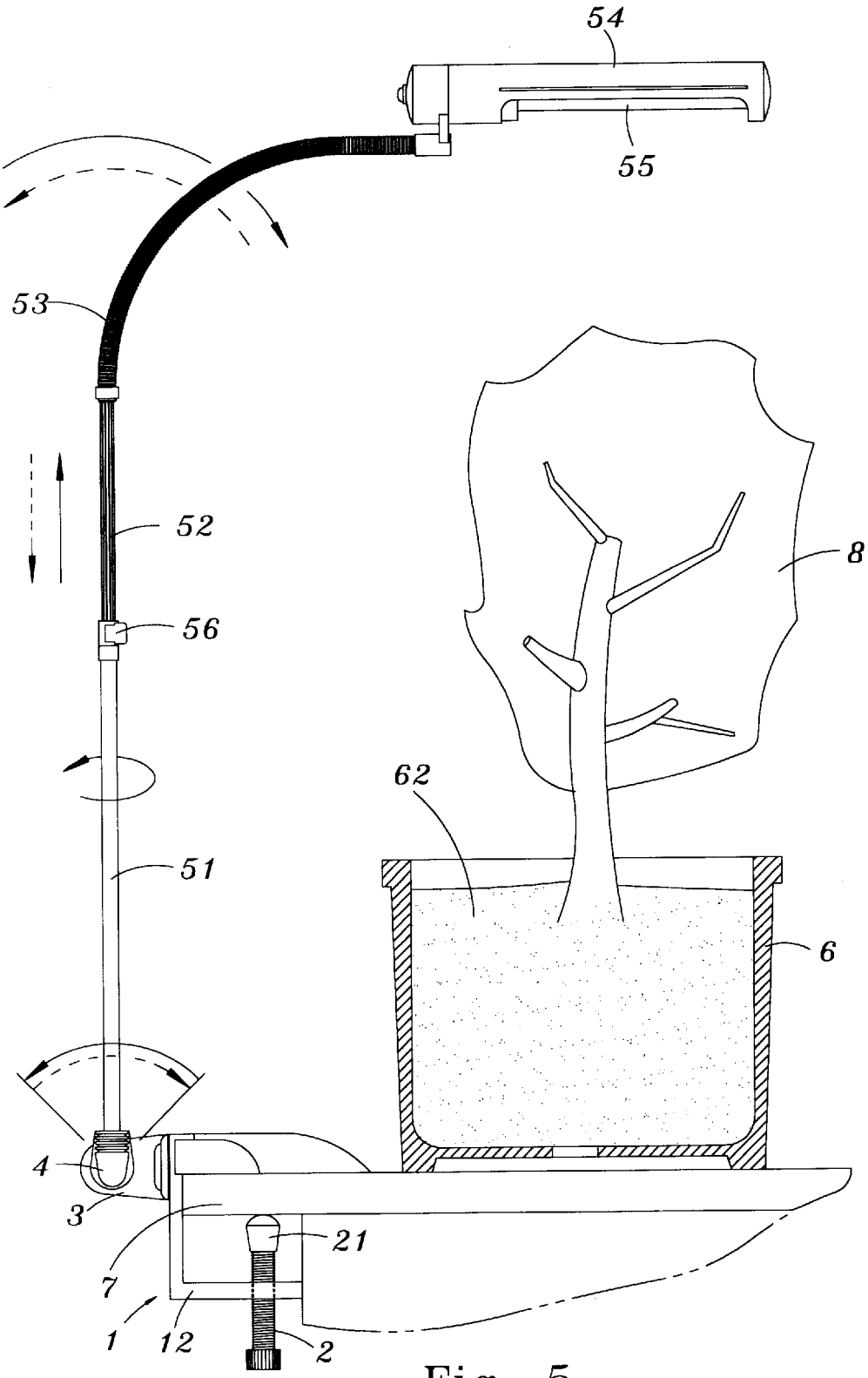
FIG. 5 is a schematic view showing clamping of the clamping holder of the present invention on a flower nursery platform.

The shovel shaped insertion arm 11 is for inserting into the soil 62 for positioning the clamping holder (as shown in FIG. 4), or is laid flat on a flower nursery platform 7 (as shown in FIG. 5) to be used as a seat plate for the clamping holder.

The plain clamping arm 12 is provided with a threaded hole 14 for screwing therein a clamping bolt 2 (as shown in FIG. 1). The head of the clamping bolt 2 is provided with a soft protecting cushion 21 to enhance the clamping function between the clamping holder and the wall of a flowerpot 6 or the flower nursery platform 7 (also referring to FIG. 4 and 5).

Figure 2:
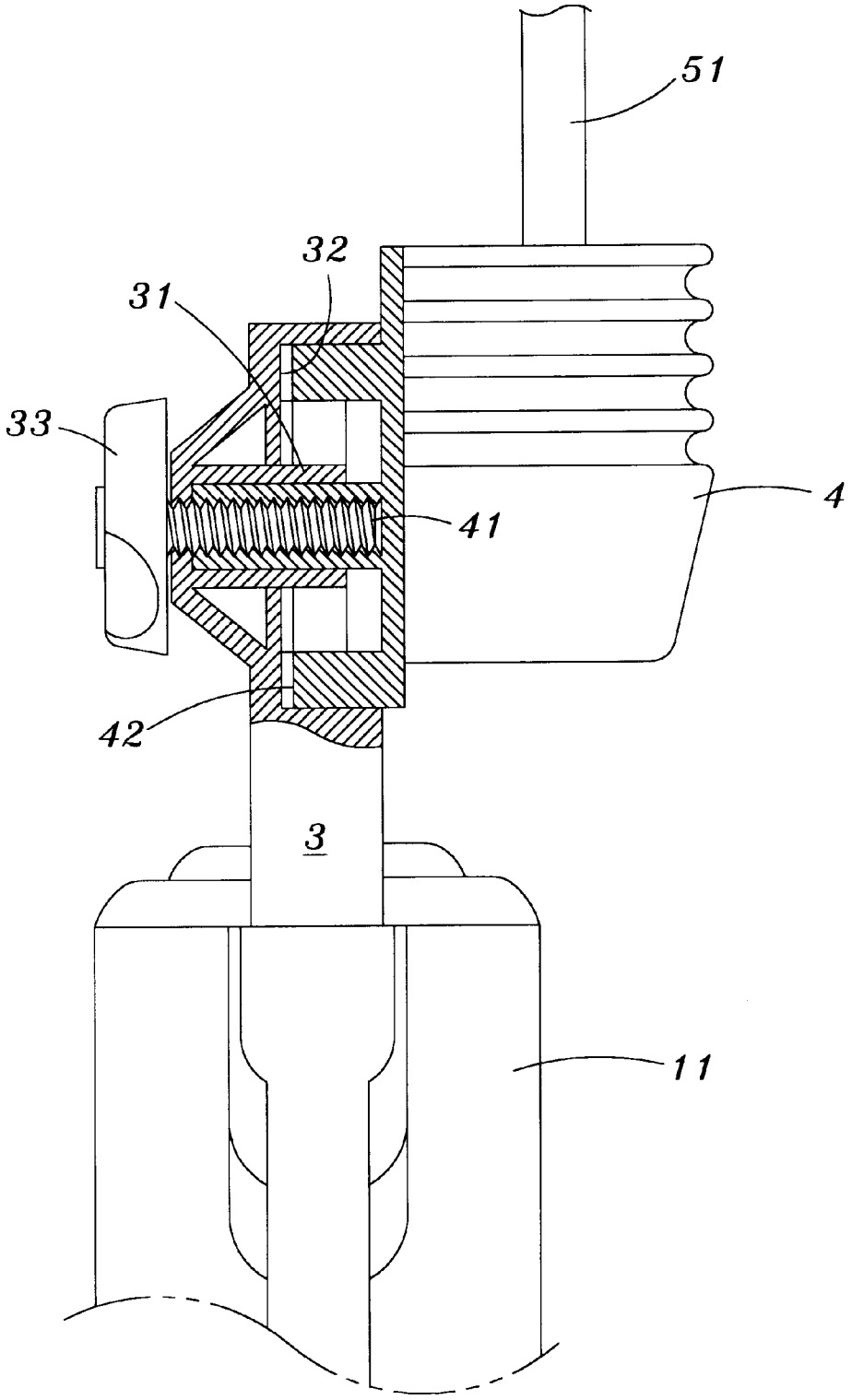
FIG. 2 is a sectional view showing engagement of the clamping holder of the present invention with the connector for the lamp bar.
Figure 3:
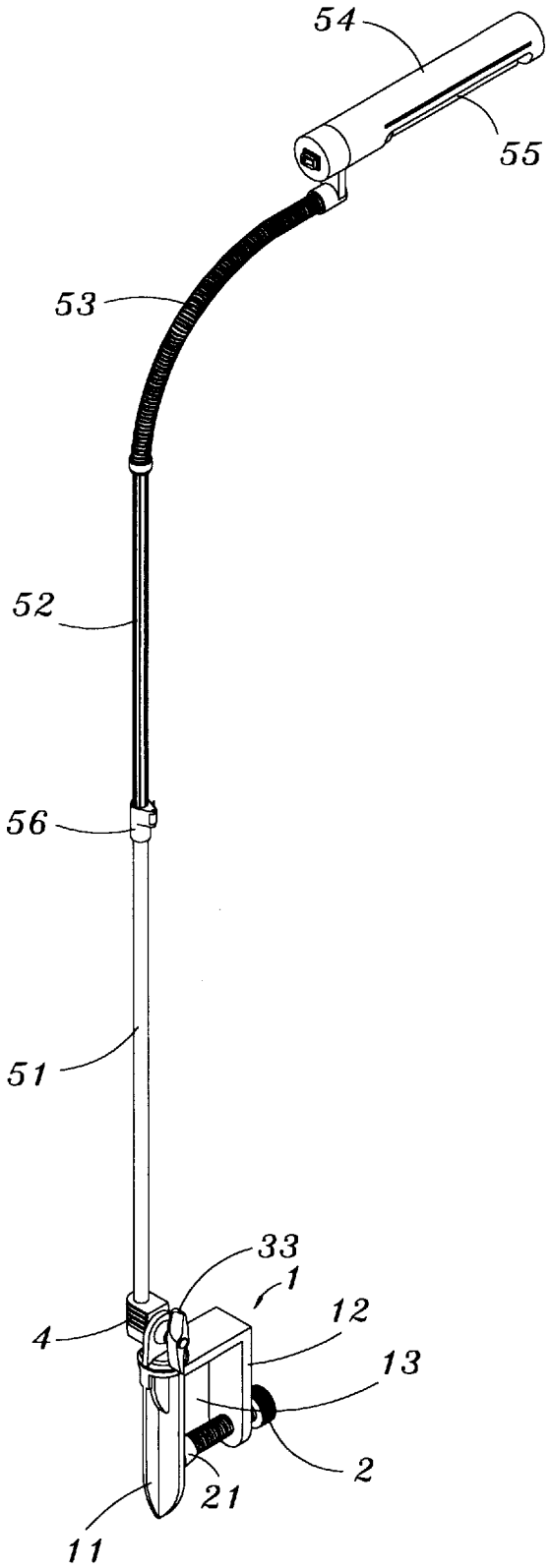
FIG. 3 is a perspective view showing assembling of the clamping holder of the present invention with the lamp.

The inverse "U" shaped main body 1 is provided with a lock seat 3 which has thereon a bolt hole 31 and an annular toothed recess 32 circling the bolt hole 31. A nut 33 is provided to engage through the bolt hole 31 with a lamp bar connector 4 having a central bolt 41 and an annular toothed cylinder 42 thereabout (as shown in FIG. 1 and 2). When the nut 33 is screwed tight onto the central bolt 41, the annular toothed cylinder 42 is engaged in the annular toothed recess 32 (as shown in FIG. 2), the whole lamp 5 can thereby be fixed on the clamping holder. When the nut 33 is screwed appropriately to loosen from the central bolt 41, the annular toothed cylinder 42 is slightly released from the annular toothed recess 32. In this way, the mounting angle of the lamp bar 51 can be adjusted; and then the nut 33 can be screwed tight again.

The lamp 5 includes the lamp bar 51 pivotally mounted on the lamp bar connector 4, a telescopically movable rod 52 provided on the lamp bar 51, an all direction flexible hose 53 provided on the telescopically movable rod 52, a lampshade 54 on the hose 53 and a lamp tube 55 in the lampshade 54 (as shown in FIG. 1). The lamp bar 51 and the telescopically movable rod 52 are connected by a binding member 56 to allow adjustment for raising and lowering and of orientation as well as fixing of the lamp in illumination (also referring to FIGS. 4 and 5).

Accordingly, it can be seen that, the clamping holder of the present invention for mounting the lamp 5 is a specific device designed for use in the environment having a flowerpot 6 or a flower nursery platform 7 used for planting plant 8. The clamping holder can both firmly mount the lamp 5 on the flowerpot 6 or the flower nursery platform 7 as well as adjust the orientation of the lamp bar 51 connected with the clamping holder. And thereby can control and obtain the best distance and angle of illumination and the best mounting position of the lamp on the plant 8. The present invention is really practical in convenience and firmness in mounting and adjustment.

Having thus described my invention, what I claim as new and desire to be secured by Letters Patent of the United States are:

1. A clamping holder to couple a lamp to a flowerpot or flower nursery platform comprising an inverse "U" shaped main body having a lock seat and a clamping bolt thereon, wherein said lock seat is provided to engage a lamp bar connector having a central bolt and an annular toothed cylinder thereabout, said inverse "U" shaped main body is used to clamp and fix a lamp on a flowerpot or a flower nursery platform, said clamping holder is characterized by said lock seat on said inverse "U" shaped main body is provided with a bolt hole and an annular toothed recess circling said bolt hole, a nut is used to engage through said bolt hole with a lamp bar connector having said central bolt and said annular toothed cylinder thereabout, said annular toothed cylinder thus is engaged in said annular toothed recess, said lamp bar connector thereby is fixed on said clamping holder; said main body is formed on two ends thereof respectively a shovel shaped insertion arm and a plain clamping arm, a clamping space is formed between said insertion arm and said clamping arm, said clamping arm is provided with a threaded hole for screwing therein said clamping bolt, said shovel shaped insertion arm is mounted and clamped on the flowerpot or flower nursery platform for firm supporting a lamp on said inverse "U" shaped main body through said lamp bar connector.

2. A clamping holder for a lamp used for a flowerpot as stated in claim 1, wherein, the opposite sides facing to each other of said shovel shaped insertion arm and said plain clamping arm both are made plane.

* * * * *